US006230335B1

(12) United States Patent
Miller

(10) Patent No.: US 6,230,335 B1
(45) Date of Patent: May 15, 2001

(54) NORMALLY UPRIGHT TOILET STOOL-SEAT ASSEMBLY

(76) Inventor: David P. Miller, P.O. Box 126, Libertyville, IA (US) 52567-0126

( * ) Notice: Subject to any disclaimer, the term of this patent is extended or adjusted under 35 U.S.C. 154(b) by 0 days.

(21) Appl. No.: 09/551,928

(22) Filed: Apr. 19, 2000

(51) Int. Cl.[7] ..... A47K 13/00

(52) U.S. Cl. ..... 4/237; 4/236; 4/240; 4/241; 4/246.1

(58) Field of Search ..... 4/237, 236, 240, 4/241, 246.1; 16/DIG. 33, DIG. 36, DIG. 10, 72, 401, 277, 281, 286; 248/160

(56) References Cited

U.S. PATENT DOCUMENTS

| | | | | |
|---|---|---|---|---|
| 96,002 | * | 10/1869 | Harpster . | |
| 362,424 | * | 5/1887 | Burrows . | |
| 719,925 | * | 2/1903 | White . | |
| 952,956 | * | 3/1910 | Spalding . | |
| 953,302 | * | 3/1910 | Spalding . | |
| 1,529,656 | * | 3/1925 | Kornhauser . | |
| 2,181,017 | * | 11/1939 | Hill . | |
| 2,253,606 | | 8/1941 | Boltz . | |
| 2,305,147 | * | 12/1942 | Deal . | |
| 2,507,965 | | 5/1950 | Eichner . | |
| 2,607,411 | | 8/1952 | Van Vliet . | |
| 2,666,521 | | 1/1954 | Miller et al. . | |
| 2,745,133 | | 5/1956 | McWethy . | |
| 2,877,469 | * | 3/1959 | Johnson . | |
| 3,192,556 | | 7/1965 | Himelreich . | |
| 3,447,169 | * | 6/1969 | Watson . | |
| 3,474,470 | | 10/1969 | Watson . | |
| 3,541,730 | * | 11/1970 | Ballantyne . | |
| 3,665,552 | | 5/1972 | Toldo et al. . | |
| 3,749,274 | * | 7/1973 | Mele et al. . | |
| 3,754,300 | | 8/1973 | Shepard . | |
| 4,965,890 | * | 10/1990 | Fischer | 4/240 |
| 5,061,137 | | 10/1991 | Gourd . | |
| 5,148,850 | | 9/1992 | Urbanick . | |
| 5,205,016 | * | 4/1993 | Kulot et al. | 16/82 |
| 5,379,465 | * | 1/1995 | Vaughn | 4/246.1 |
| 5,898,953 | * | 5/1999 | Paxon | 4/241 |
| 6,012,180 | * | 1/2000 | Williams | 4/241 |
| 6,061,845 | * | 5/2000 | Kakutani | 4/483 |

* cited by examiner

*Primary Examiner*—Gregory L. Huson
*Assistant Examiner*—Khoa D. Huynh
(74) *Attorney, Agent, or Firm*—Schroeder & Siegfried P.A.

(57) ABSTRACT

A one-piece toilet seat hinge composed of an elastomeric material throughout, and having the characteristics of rubber, and including a flat flange member and a coplanar support shank, the flange member being designed to be connected to the toilet seat and the support shank being generally cylindrical in shape and externally threaded to facilitate mounting thereof within a cavity normally found on the toilet stool for connection of the seat thereto. The flange member has lower peripheral portions having sufficient memory to cause the toilet seat to swing from a horizontal orientation, upon release, to a vertically extending orientation, thereby obviating the likelihood of the seat being soiled by a subsequent male urinator.

9 Claims, 3 Drawing Sheets

Fig. 6
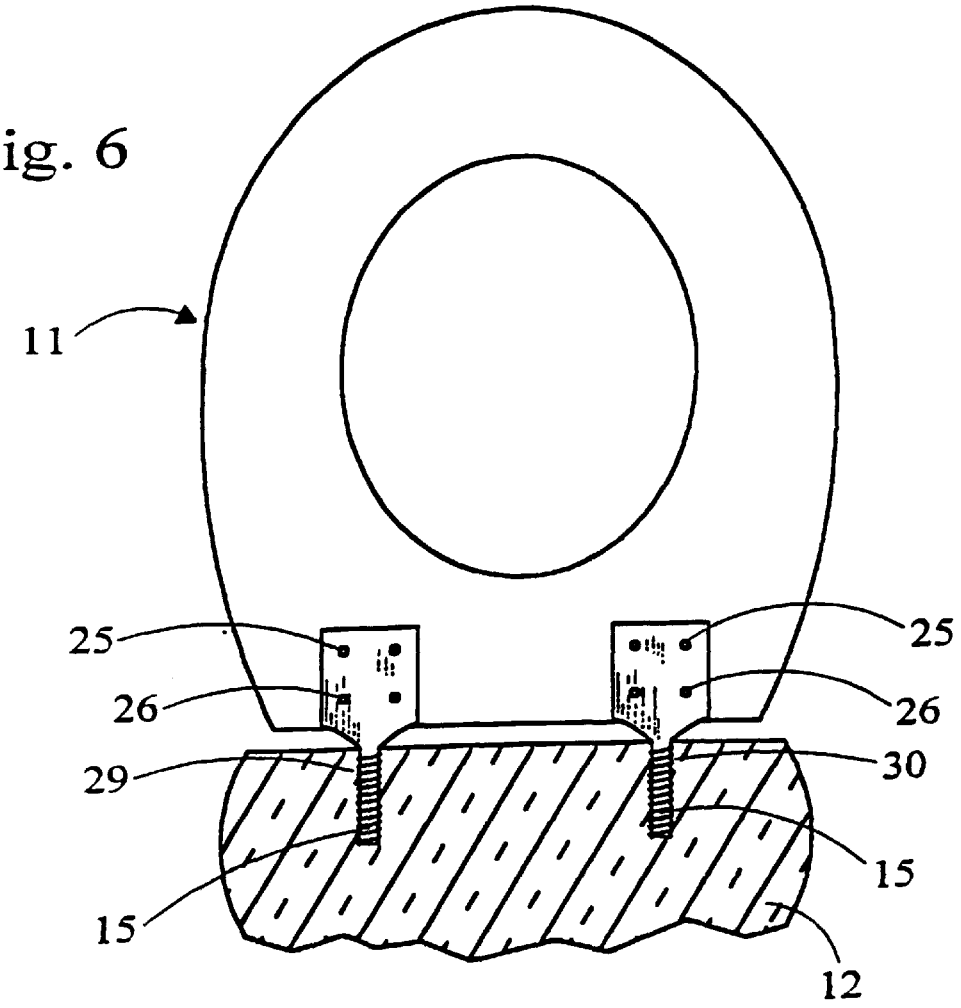
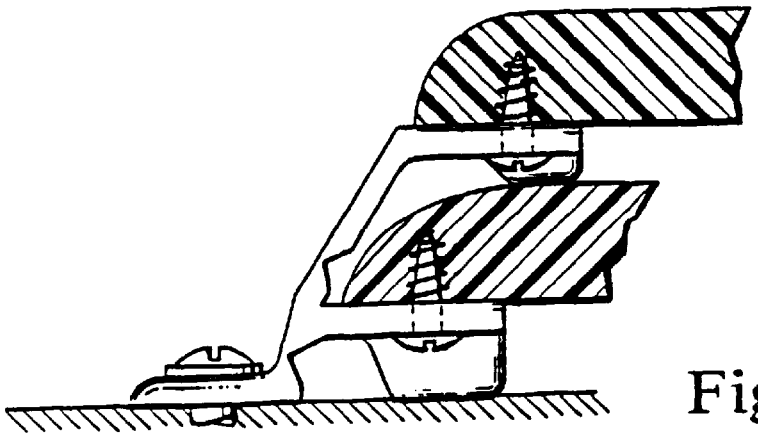
Fig. 7
PRIOR ART

NORMALLY UPRIGHT TOILET STOOL-SEAT ASSEMBLY

BACKGROUND OF THE INVENTION

A common problem, especially in public toilets, is the failure of male urinators to raise the toilet seat to a vertical position before urinating. As a consequence, such seats are frequently found to be unsanitary, as a result of being soiled by a previous user while urinating from a standing position. Various attempts and practices have been urged in an effort to eliminate this unfortunate and highly disagreeable practice, but to date no satisfactory solution has been found.

BRIEF SUMMARY OF THE INVENTION

My invention consists of providing a unique mounting for the toilet seat which effectively eliminates the above problem. I have designed a rubber or elastomeric hinge which can be used to mount the toilet seat upon the toilet bowl so as to be maintained normally in an upstanding or vertical position. Thus, if the user wished to utilize the seat, it is a simple matter to swing same to a horizontal orientation. Upon release by the user, the toilet seat is caused, by the inherent memory of the rubber hinge mounting, to return to its prior vertically extending position. The hinge is designed to extend in a planar vertical fashion and to be connected to the under surface of the toilet seat in parallel abutting relation. When the seat is swung to a horizontal position, the rubber hinge is caused to flex out of its plane, thereby inducing stress within the body of the hinge, which urges the seat toward a vertically extending out-of-way position. Upon release, the hinge forces the seat upwardly and, at the same time, relieves the previously induced stress within the hinge.

DETAILED DESCRIPTION OF THE INVENTION

In considering this invention, it should be remembered that the present disclosure is illustrative only and the scope of the invention should be determined by the appended claims.

The primary object of the invention is to provide a mounting for a toilet stool-seat which will insure that such a seat, when not in use, is oriented in a vertical position to thereby obviate the long-experienced problem of toilet seats being left in a soiled condition by non-thinking users of the toilet. As indicated above, I have accomplished this by designing a rubber hinge which is fixedly secured to the under side of the toilet seat and extends parallel thereto, so that when it is mounted upon the toilet stool so as to extend in a vertical direction while not under stress, stress will be induced within the hinge when the seat is swung to a horizontally extending position. This stress, in turn, causes the toilet seat to return to and remain at a vertically extending position, as soon as the seat is released from its horizontally extending position.

These and other objects and advantages of the invention will more fully appear from the following description, made in connection with the accompanying drawings, wherein like reference characters refer to the same or similar parts throughout the several views and in which:

FIG. 6 is a front elevational view of a pair of my rubber hinges shown mounting a toilet seat upon a toilet stool, the latter being shown in section and the seat and hinges being shown in elevation.

FIG. 7 is a side elevational view, showing the Prior Art.

As best shown in FIGS. 1–6, I have provided a flange 10 a pair of which function as hinges, to mount a toilet-seat 11 upon a toilet stool 12. As indicated hereinabove, a pair of the flanges is fixedly connected in transverse spaced relation to the underside of the toilet seat 11. Only one of the flanges can be seen in FIG. 5, because the second is hidden behind the adjacent member.

Figure 1:
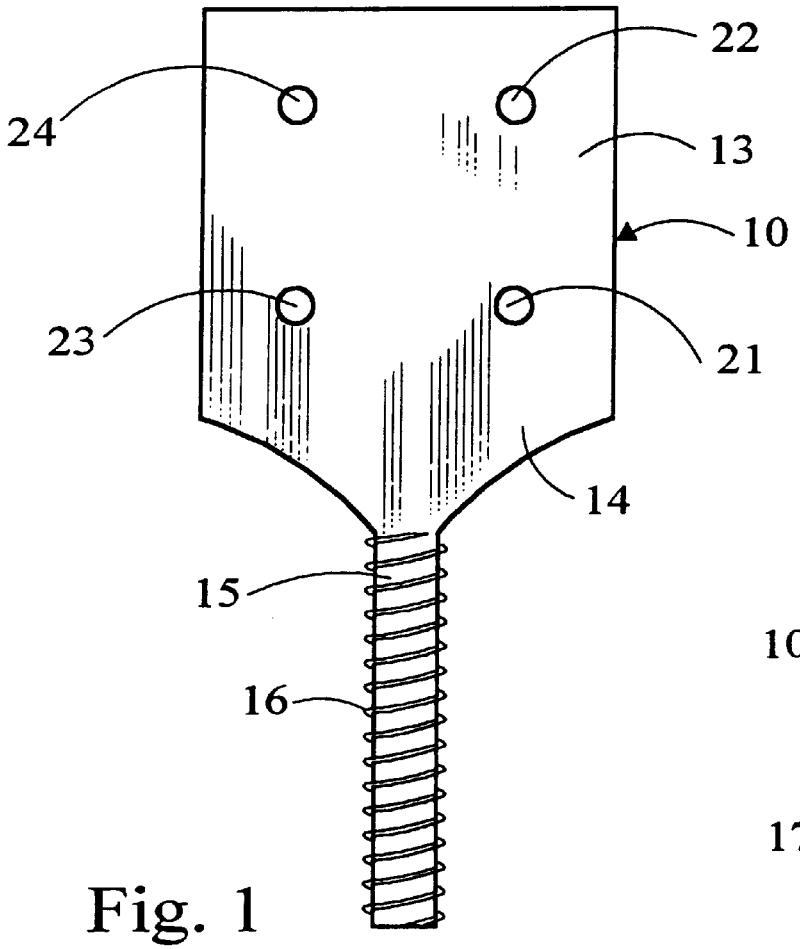
FIG. 1 is a front elevational view of one of my said hinge members.
Figure 2:
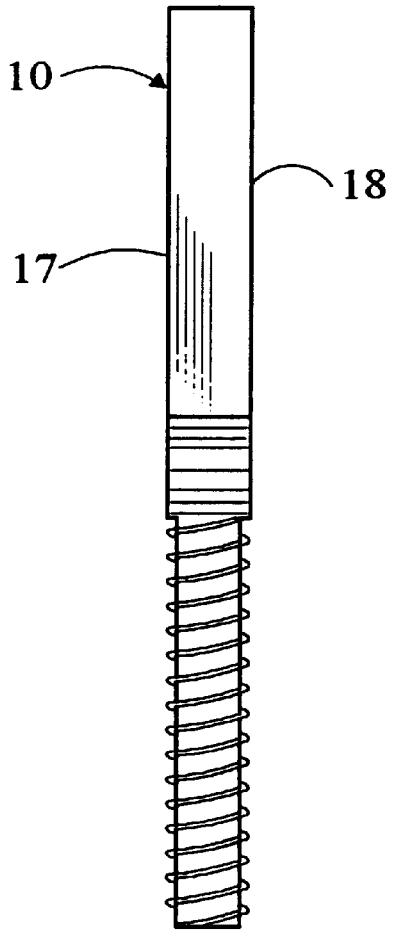
FIG. 2 is a side elevational view of the same.
Figure 3:
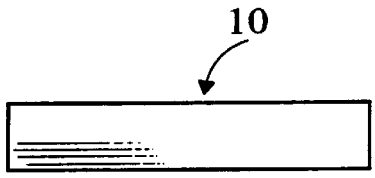
FIG. 3 is a top plan view of the same.
Figure 4:
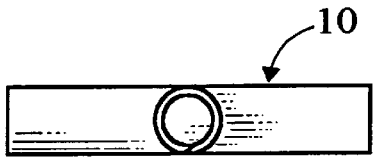
FIG. 4 is a bottom plan view of the same.

As best seen in FIGS. 1–4, the flange or hinge member 10 is comprised of a generally rectangularly shaped planar upper portion 13, and a lower peripheral portion 14, the latter merging into a depending shank 15 which is externally threaded as at 16. As best shown in FIG. 2, the hinge member 10 has opposed flat sides 17 and 18, and the support shank 15 extends substantially planar therewith. It will be seen that the flat sides 17 and 18 extend parallel to each other. As indicated hereinabove, the member 10 is made of rubber or an elastomeric equivalent, and is of one-piece construction.

A pair of the members 10 is secured to the under side of the toilet seat 11 by connector means in the form of bolts 19 and 20 which extend through the lower portions of the seat 11 and the openings 21–24, which extend through the planar upper portion of the member 10. Thus the two members 10 and 11 are fixedly connected to each other and secured by nuts 25 and 26.

The toilet stool 12, as is conventional, is provided with a pair of transversely spaced vertical openings, such as indicated by the numeral 27 thru which the support shank 15 extends. A nut 28 may be utilized to secure the member 10 and the seat 11 to the rear portion of the toilet stool 12, as shown in FIG. 5.

A similar but slightly different mounting is shown in FIG. 6 in which the toilet stool has been similarly identified by numeral 12 and a pair of vertically extending internally threaded cavities 29 and 30 are provided. The threads of these internally threaded openings or cavities are of a size and pitch such as to cooperate with the threads 16 of the members 10. When utilizing such a toilet stool, the members 10 are simply screwed into the openings 29 and 30, and thereafter secured to the underside of the toilet seat, as shown in FIG. 6. It will be noted that the shanks 15 of the hinges extend vertically and as a consequence, the upper planar portion 13 likewise extends vertically with the similarly extending seat 11.

Figure 5:
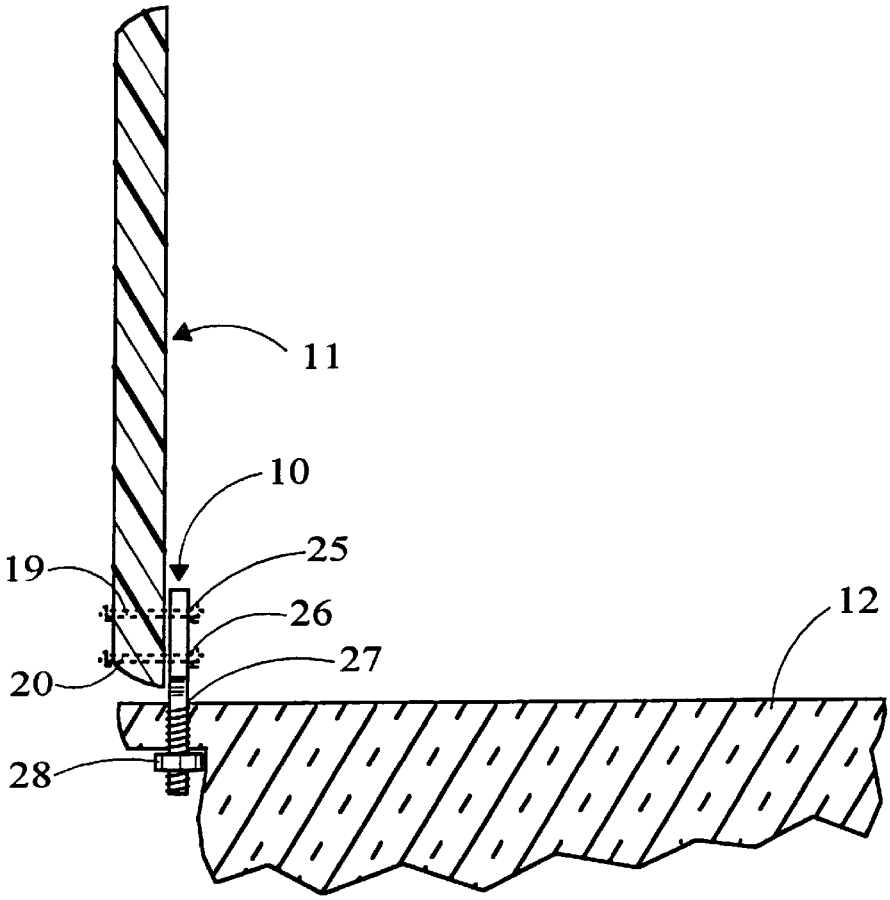
FIG. 5 is a side elevational view of one of my hinge members installed to mount a toilet seat on a toilet stool, the stool being shown in section and the toilet seat in elevation.

It can be readably seen by reference to FIGS. 5 and 6 that the toilet seats 11 are held in a vertically extending position while the hinges 10 are not under stress. It will be readily appreciated, however, that when the seat members 11 are swung forwardly to a horizontal position, the lower peripheral portions of the members 10 are placed under stress because of the memory inherent in the rubber and elastomeric material from which the hinges 10 are formed. The material from which these members are formed is selected so that the lower peripheral portions 14 have sufficient memory to cause the seat 11 attached thereto to be quickly swung to a vertically extending position as soon as the seat is released from a horizontally extending position. Thus, as a consequence, the seat 11 is held in vertical orientation during all time that the seat has not been forcibly moved or swung to a horizontal position, so as to rest upon the upper surface of the stool 12.

From the above it can be seen that I have provided a simple, inexpensive solution to a vexing problem as a consequence of the unique mounting which I have disclosed, in which the toilet seat is held in a vertical out-of-way position at all times except when it has been forcibly swung to and maintained in a horizontal position.

It will, of course, be understood that various changes may be made in the form, details, arrangement and proportions of the parts without departing from the scope of the invention which comprises the matter shown and described herein and set forth in the appended claims.

What is claimed is:

1. A normally upright Toilet Stool-Seat assembly having in combination:

(a) a toilet stool having at least one vertically extending stool-seat hinge-receiving cavity;

(b) a toilet stool-seat;

(c) at least one stool-seat hinge member mounted in said cavity;

(d) said hinge member being composed of a flexible material having the memory characteristics of rubber and having a lower planar peripheral portion and a substantially planar upper portion;

(e) connector means connecting said planar upper portion of said hinge member to said stool-seat in parallel abutting and supporting relations;

(f) a support shank connected to and extending downwardly and in substantially planar relation to said lower peripheral portion of said hinge member and being mounted in said cavity in vertically supporting relation to said hinge member;

(g) said lower peripheral portion of said hinge member having sufficient inherent memory throughout to cause said hinge member to constantly urge and return said stool-seat, upon release, from an off-vertically extending position to a substantially vertically extending position; and (h) said hinge member and said support shank comprising a one-piece composition made of a single material.

2. The combination defined in claim 1, wherein said support shank is generally cylindrical in shape and is externally threaded.

3. The combination defined in claim 1, wherein said hinge member is flat.

4. The combination defined in claim 1, wherein said hinge member has opposite flat parallel sides.

5. The combination of:

(a) a toilet stool;

(b) a stool-seat;

(c) said toilet stool having means for connecting said stool-seat thereto;

a flange member composed of a material having memory characteristics of rubber, and having a lower peripheral portion and having a planar upper portion which is substantially planar with said lower peripheral portion;

(e) connector means connecting said planar upper portion of said flange member to said stool-seat in parallel abutting and supporting relation;

(f) a generally cylindrical, externally threaded support shank connected in planar relation to said lower peripheral portions of said flange member and cooperating with said connecting means of said toilet stool to cooperatively mount said flange member and said stool-seat upon said toilet stool in a normal upstanding position;

(g) said support shank being made in one-piece with said flange member and of the same material as said flange member; and (h) said flange member having sufficient inherent memory therein to cause said flange member to constantly urge said stool-seat to return, upon release from an off-vertically extending position, to a substantially vertically extending position.

6. An elastomeric bathroom stool-seat hinge for urging a off-vertical stool-seat toward vertical orientation at all times, comprising;

(a) a flange member composed of elastomeric material having the memory characteristics of rubber, and having lower peripheral portions, and having a planar upper portion, with means incorporated in said planar upper portion for facilitating attachment thereof to such a stool-seat in parallel abutting and vertically supporting, relation thereto;

(b) a support shank connected to said lower peripheral portions of said flange member and extending downwardly therefrom in longitudinal coplanar supporting relation when the stool-seat is in vertical position;

(c) said support shank being constructed and arranged for connection to such a bathroom stool in vertically extending supporting relation to said lower peripheral portions; and (d) said lower peripheral portions of said flange member having sufficient inherent memory throughout to cause said flange member to return such a so-attached stool-seat, upon release, from each off-vertically extending positions to a substantially vertically extending position.

7. The hinge defined in claim 6, wherein said flange member and support shank are of a one-piece construction.

8. The hinge defined in claim 6, wherein said support shank is generally cylindrical in shape and is externally threaded.

9. The hinge defined in claim 6, wherein said flange member has opposite flat sides.

* * * * *